US008206081B2

(12) United States Patent
Stones

(10) Patent No.: US 8,206,081 B2
(45) Date of Patent: Jun. 26, 2012

(54) VACUUM PUMP

(75) Inventor: Ian David Stones, Burgess Hill (GB)

(73) Assignee: Edwards Limited, Crawley, West Sussex (GB)

( * ) Notice: Subject to any disclaimer, the term of this patent is extended or adjusted under 35 U.S.C. 154(b) by 877 days.

(21) Appl. No.: 11/666,724

(22) PCT Filed: Oct. 19, 2005

(86) PCT No.: PCT/GB2005/004042

§ 371 (c)(1),
(2), (4) Date: Oct. 6, 2008

(87) PCT Pub. No.: WO2006/048603

PCT Pub. Date: May 11, 2006

(65) Prior Publication Data

US 2009/0035123 A1 Feb. 5, 2009

(30) Foreign Application Priority Data

Nov. 1, 2004 (GB) ..... 0424199.8

(51) Int. Cl.

| | |
|---|---|
| ***F01D 1/36*** | (2006.01) |
| ***F01D 13/00*** | (2006.01) |
| ***F03B 5/00*** | (2006.01) |
| ***F04D 31/00*** | (2006.01) |
| ***F04D 29/44*** | (2006.01) |

(52) U.S. Cl. ..... 415/90; 415/116; 415/211.2; 415/143

(58) Field of Classification Search ..... 415/90, 415/116, 211.2, 73, 71, 143, 121.2, 83, 77, 415/169.1, 84

See application file for complete search history.

(56) References Cited

U.S. PATENT DOCUMENTS

| | | | | |
|---|---|---|---|---|
| 2,730,297 | A | 1/1956 | Dorsten et al. | |
| 4,978,276 | A | 12/1990 | Kabelitz et al. | |
| 5,893,702 | A | 4/1999 | Conrad et al. | |
| 6,726,443 | B2 * | 4/2004 | Collins et al. | 415/90 |

FOREIGN PATENT DOCUMENTS

| | | |
|---|---|---|
| EP | 0 779 434 A1 | 6/1997 |
| EP | 0 919 726 A1 | 6/1999 |
| GB | 242084 | 11/1925 |

OTHER PUBLICATIONS

United Kingdom Search Report mailed Sep. 6, 2005 for Application No. GB042499.8; Claims searched: 1-18; Date of Search: Sep. 5, 2005.

PCT Notification of Transmittal of the International Search Report and the Written Opinion of the International Searching Authority, or the Declaration of International Application No. PCT/GB2005/004042; Date of mailing: Feb. 6, 2006.

PCT International Search Report of International Application No. PCT/GB2005/004042; Date of mailing of the International Search Report: Feb. 6, 2006.

PCT Written Opinion of the International Searching Authority of International Application No. PCT/GB2005/004042; Date of mailing: Feb. 6, 2006.

* cited by examiner

*Primary Examiner* — Chuong A. Luu

(57) ABSTRACT

A vacuum pump (100) comprises a pumping mechanism having an annular pumping chamber (112, 114, 116) extending about a longitudinal axis (107) and through which fluid is pumped by the pumping mechanism. A plenum (126) located remote from the pumping mechanism has an inlet (128) for receiving fluid to be pumped by the pumping mechanism and a plurality of outlets (132) arranged about the longitudinal axis (107) for supplying fluid to the annular chamber.

19 Claims, 6 Drawing Sheets

VACUUM PUMP

FIELD OF THE INVENTION

This invention relates to vacuum pumps, and is directed to improvements in the operational efficiency of such pumps.

BACKGROUND OF THE INVENTION

There are a number of types of apparatus where a plurality of chambers or systems need to be evacuated down to different levels of vacuum. For example, in well known types of mass spectrometer, the analyser/detector has to be operated at a relatively high vacuum, for example $10^{-5}$ mbar, whereas a transfer or optics chamber, through which ions drawn and guided from an ion source are conveyed towards the detector, is operated at a lower vacuum, for example $10^{-3}$ mbar. The mass spectrometer may comprise one or more further chambers upstream from the analyser chamber, which are operated at progressively higher pressures to enable ions generated in an atmospheric source to be captured and eventually guided towards the detector.

Whilst these chambers may be evacuated using separate vacuum pumps, each backed by a separate, or common, backing pump, it is becoming increasingly common to evacuate two or more adjacent chambers using a single, "split flow" pump having a plurality of inlets each for receiving fluid from respective chamber, and a plurality of pumping stages for differentially evacuating the chambers. Utilising such a pump offers advantages in size, cost, and component rationalisation.

For example, EP-A 0 919 726 describes a split flow pump comprising a plurality of vacuum stages and having a first pump inlet through which gas can enter the pump and pass through all of the stages, and a second inlet through which gas can enter the pump at an inter-stage location and pass only through subsequent stages of the pump. The pump stages can be configured to meet the pressure requirements of the chambers attached to the first and the second inlets respectively.

International patent application no PCT/GB2004/004046 filed by The BOC Group plc; the contents of which are incorporated herein by reference, describes a split flow pump in which a pump inlet for receiving gas from a high pressure chamber is located between stages of a multi-stage Holweck molecular drag mechanism. FIG. 1 is a cross-sectional view of part of a split flow pump 10 similar to the pump described in that application. The Holweck mechanism comprises two co-axial cylindrical rotor elements 12*a*, 12*b* of different diameters, preferably formed from a carbon fibre material, mounted on a disc 14 located on the drive shaft 16. A stator for the Holweck mechanism comprises two cylindrical stator elements 18*a*, 18*b* co-axial with the rotor elements 12*a*, 12*b* to define, in this example, three pumping stages comprising three annular pumping chambers 20, 22, 24 located between the rotor elements 12*a*, 12*b* and the stator elements 18*a*, 18*b*. The surfaces of the stator elements 18*a*, 18*b* which face a rotor element are formed with helical channels 26 in a manner known per se and as shown in FIG. 2.

The pump 10 has a first inlet (not shown) through which gas (indicated by arrows 36 in FIG. 1) enters the pump 10 and passes through all of the chambers 20, 22, 24 of the Holweck mechanism before being exhaust from the pump 10 through pump outlet 28 located in the base 30 of the pump 10. A second, interstage inlet 32 is located between the stages of Holweck mechanism so that gas (indicated by arrow 38 in FIG. 1) entering the pump through the interstage inlet 32 passes into an annular plenum 34 located between the pumping chambers 20 and 22, from which the gas 38 passes through fewer chambers of the Holweck mechanism (chambers 22 and 24 in this example) than the gas 36 before being exhaust from the pump 10 through pump outlet 28. This can provide for differential pumping of a system attached to the inlets.

With an even distribution of gas flow/pressure in a Holweck stage, each individual channel 26 of the stage is subject to the same boundary conditions (flow and pressure) and so provides the same level of performance. This is the most efficient operating condition of the Holweck stage. For instance, in the example shown in FIG. 1 gas passing through the outermost annular chamber 20 will be flowing evenly though all of the helical channels 26 of the annular chamber as it leaves the annular chamber 20. In the absence of any interstage flow 38, the gas will simply continue to flow in this manner round to the next downstream chamber 22 meaning an evenly distributed flow/pressure and good stage performance.

Now consider the other extreme case of gas distribution from the interstage inlet 32 in the absence of any gas 36 from the first inlet. The interstage gas load enters the pump 10 at a single point on the circumference of the interstage plenum 34. This gas then attempts to distribute itself around the plenum 34 prior to being pumped through the downstream annular chamber 22. However, conductance limitations of the plenum 34 can cause an uneven distribution of gas around the plenum 34 and consequently an uneven distribution of flow/pressure around the helical channels 26 of the downstream annular chamber 22. This will in turn cause poor stage performance and hence poor interstage inlet performance. Where the gas load arriving at the interstage inlet 32 far exceeds that from the first inlet and any other inlets located upstream from the Holweck mechanism, the negative behaviour of the poor distribution of the interstage gas load can dominate the performance of the Holweck mechanism.

In its preferred embodiments, the present invention seeks to improve the supply of gas to a pumping mechanism.

SUMMARY OF THE INVENTION

The present invention provides a vacuum pump comprising a pumping mechanism having an annular pumping chamber extending about a longitudinal axis and through which fluid is pumped by the pumping mechanism, and means for delivering fluid to the annular chamber, said means comprising a plenum located remote from the pumping mechanism and having an inlet for receiving fluid to be pumped by the pumping mechanism and a plurality of outlets arranged about the longitudinal axis for supplying fluid to the annular chamber.

The present invention also provides a vacuum pump comprising a pumping mechanism having a first, outer annular chamber and a second, inner annular chamber co-axial with the first annular chamber, and means for delivering fluid with said means being arranged to supply gas to a selected one of the annular chambers. This can allow gas entering the plenum to be directed to the most appropriate chamber of the pumping mechanism to meet the pumping requirements for the system connected to the plenum inlet. Preferably, said means comprises a first, outer plurality of outlets arranged about the longitudinal axis for supplying fluid to the first annular chamber, a second, inner plurality of outlets arranged about the longitudinal axis for supplying fluid to the second annular chamber, and closure means for selectively closing one of the first and second pluralities of outlets. This can enable the plenum and plenum inlet to be common to the two different pluralities of plenum outlets, thereby simplifying pump construction. The closure means preferably comprises a planar member, such as a plate or disc located between the plenum and the outlets, for selectively closing said one of the first and second pluralities of outlets. Alternatively, depending on the pump layout the plate may be located between the outlets and the pumping mechanism.

BRIEF DESCRIPTION OF THE DRAWINGS

Preferred features of the present invention will now be described, by way of example only, with reference to the following drawings, in which.

DETAILED DESCRIPTION OF THE INVENTION

Figure 1:
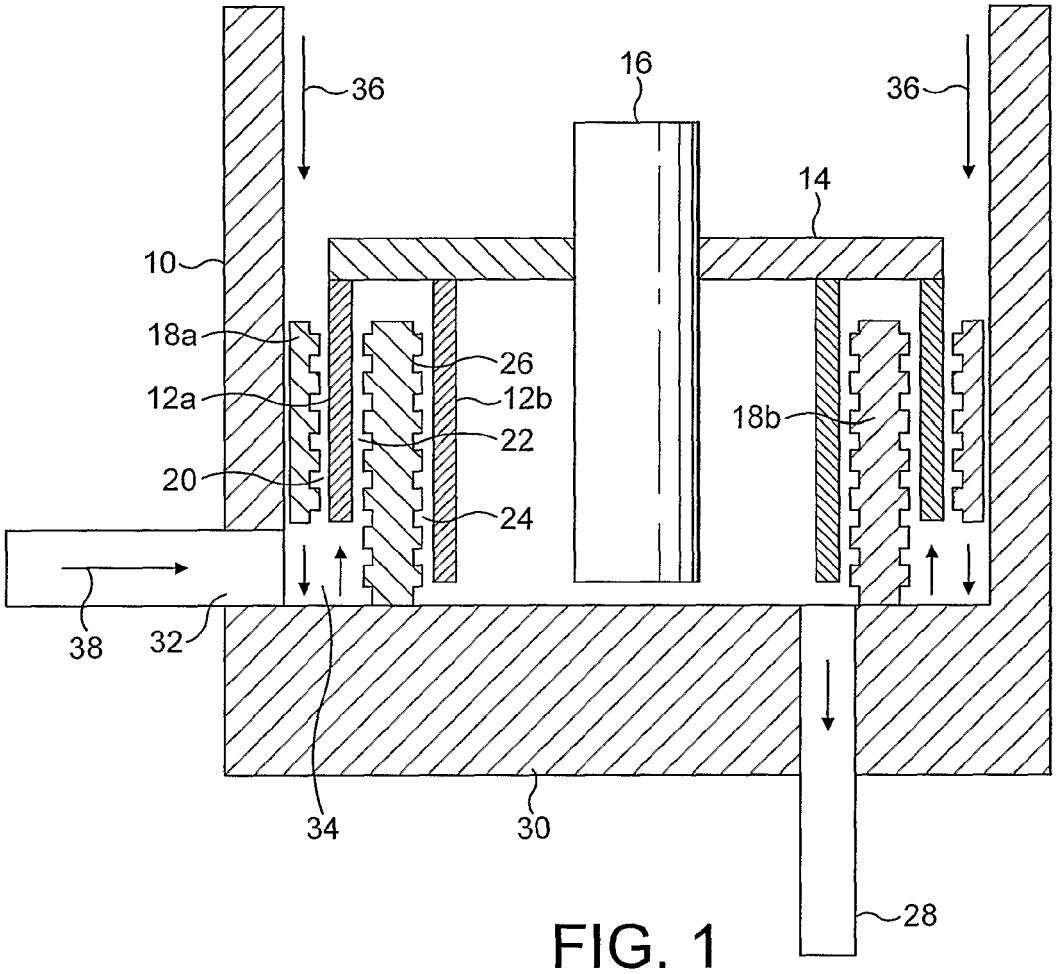
FIG. 1 is a cross-section through part of a prior split flow pump.
Figure 2:
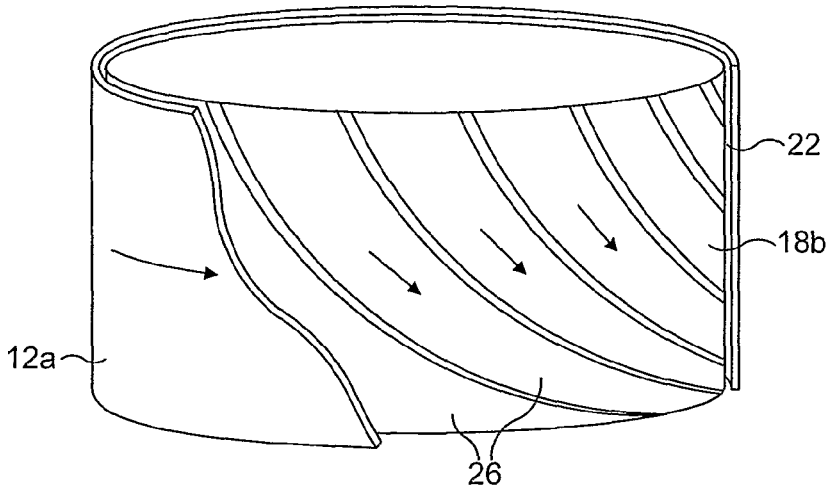
FIG. 2 illustrates the direction of gas flow through a stage of the molecular drag pumping mechanism of FIG. 1.

In a first aspect, the present invention provides a vacuum pump comprising a pumping mechanism having an annular pumping chamber extending about a longitudinal axis and through which fluid is pumped by the pumping mechanism, and means for delivering fluid to the annular chamber, said means comprising a plenum located remote from the pumping mechanism and having an inlet for receiving fluid to be pumped by the pumping mechanism and a plurality of outlets arranged about the longitudinal axis for supplying fluid to the annular chamber.

By locating the plenum remote from the pumping mechanism, a larger, less restrictive plenum with fewer space and machining constraints can be provided. The conductance of the plenum can thus be improved dramatically, and as a consequence, the gas entering the plenum through the plenum inlet can be distributed much more evenly about the plenum before leaving the plenum. The location and design of the plenum will ultimately depend on the pump layout, but in the preferred embodiments the plenum is machined into the base of the pump so that there is little, or no, increase in the size of the pump. Arranging the plenum outlets about the plenum can allow the gas entering the annular chamber to be evenly distributed thereabout, thereby not adversely affecting the even distribution of gas created by the plenum and so significantly reducing the performance losses associated with the arrangement shown in FIG. 1.

In order to enhance the even distribution of gas to the annular chamber, the outlets are preferably equidistantly spaced about and/or from the longitudinal axis, the arrangement of outlets again being dependent on the pump layout. For example, in one embodiment, the plenum has an annular form and extends about the longitudinal axis, and so the outlets can be arranged circularly about the longitudinal axis so that there is an even distribution of gas to the annular chamber. However, there may be a restriction over the shape of the plenum due to the requirement for additional pump features, such as a pump exhaust, electrical connectors, vent purges and the like, and so in another embodiment the plenum is restricted to a chamber extending less than 360°, with the outlets being arranged in an arc extending about the longitudinal axis so that the gas is evenly distributed to as much of the annular chamber as possible given the constraints of the pump design.

In another embodiment, the pumping mechanism comprises a first, outer annular chamber and a second, inner annular chamber co-axial with the first annular chamber, with said means being arranged to supply gas to a selected one of the annular chambers. This can allow gas entering the plenum to be directed to the most appropriate chamber of the pumping mechanism to meet the pumping requirements for the system connected to the plenum inlet. Preferably, said means comprises a first, outer plurality of outlets arranged about the longitudinal axis for supplying fluid to the first annular chamber, a second, inner plurality of outlets arranged about the longitudinal axis for supplying fluid to the second annular chamber, and closure means for selectively closing one of the first and second pluralities of outlets. This can enable the plenum and plenum inlet to be common to the two different pluralities of plenum outlets, thereby simplifying pump construction. The closure means preferably comprises a planar member, such as a plate or disc located between the plenum and the outlets, for selectively closing said one of the first and second pluralities of outlets. Alternatively, depending on the pump layout the plate may be located between the outlets and the pumping mechanism.

This plate may comprise a single aperture through which fluid is conveyed from the plenum to, for example, the first plurality of outlets only, or alternatively may comprise a plurality of apertures each of which is co-axial with a respective outlet of the first plurality of outlets. In order to close the first plurality of outlets instead, the plate can be removed and replaced by another plate having a different aperture arrangement through which fluid is conveyed from the plenum to the second plurality of outlets only. However, in a more convenient alternative arrangement, the plate is movable between a first position in which the first plurality of outlets are closed, and a second position in which the second plurality of outlets are closed, thereby enabling the different annular chambers to be accessed as required using the same components. This can be achieved by providing in the plate first and second sets of apertures positioned such that in the first plate position each of the apertures from the first set is co-axial with a respective outlet of the first plurality of outlets, and in the second plate position each of the apertures from the second set is co-axial with a respective outlet from the second plurality of apertures. The plate is preferably rotatable about the longitudinal axis between the first and second positions to close the selected plurality of outlets. The plate may be provided with a notch or any other convenient indicator for enabling a user to determine the current position of the plate and thus the current pump performance configuration at the plenum inlet.

In the preferred embodiments, the first and second annular chambers are linked to form a continuous passageway through which fluid is pumped by the pumping mechanism. The pumping mechanism preferably comprises a multi-chamber molecular drag pumping mechanism comprising a plurality of co-axial cylindrical rotor elements and a stator defining with the rotor elements the first and second annular chambers. In the preferred embodiment, the molecular drag pumping mechanism is a multi-stage Holweck mechanism in which the first and second annular chambers are arranged as a plurality of helixes. Additional pumping stages, for example at least one Gaede pumping stage and/or at least one aerodynamic pumping stage, may be located downstream from the Holweck mechanism as required. The aerodynamic pumping stage may be a regenerative stage. Other types of aerodynamic mechanism may be side flow, side channel, and peripheral flow mechanisms. The first and second annular chambers may each be located between two pumping stages.

In the first aspect of the invention, the fluid delivery system serves to evenly distribute fluid for supply to an annular chamber, and thereby improve the conductance of the fluid supply. However, the same system can also be used to convey fluid away from the annular chamber, by swapping the functions of the plenum inlet and plenum outlets so that gas received from the pumping mechanism is re-distributed from an annular flow to a linear flow, (for example, to provide the gas from a Holweck mechanism to a pump outlet or to a downstream pumping stage such as a regenerative or Gaede pumping stage) and so in a second aspect the present invention provides a vacuum pump comprising a pumping mechanism having an annular pumping chamber extending about a longitudinal axis and through which fluid is pumped by the pumping mechanism, and means for receiving fluid from the annular chamber, said means comprising a plenum located remote from the pumping mechanism and having a plurality of inlets arranged about the longitudinal axis for receiving fluid from the annular chamber and an outlet for exhausting fluid from the plenum. Features described above in relation to the plenum inlet and plenum outlets of the first aspect are equally applicable to the plenum outlet and plenum inlets, respectively, of the second aspect.

Figure 3:
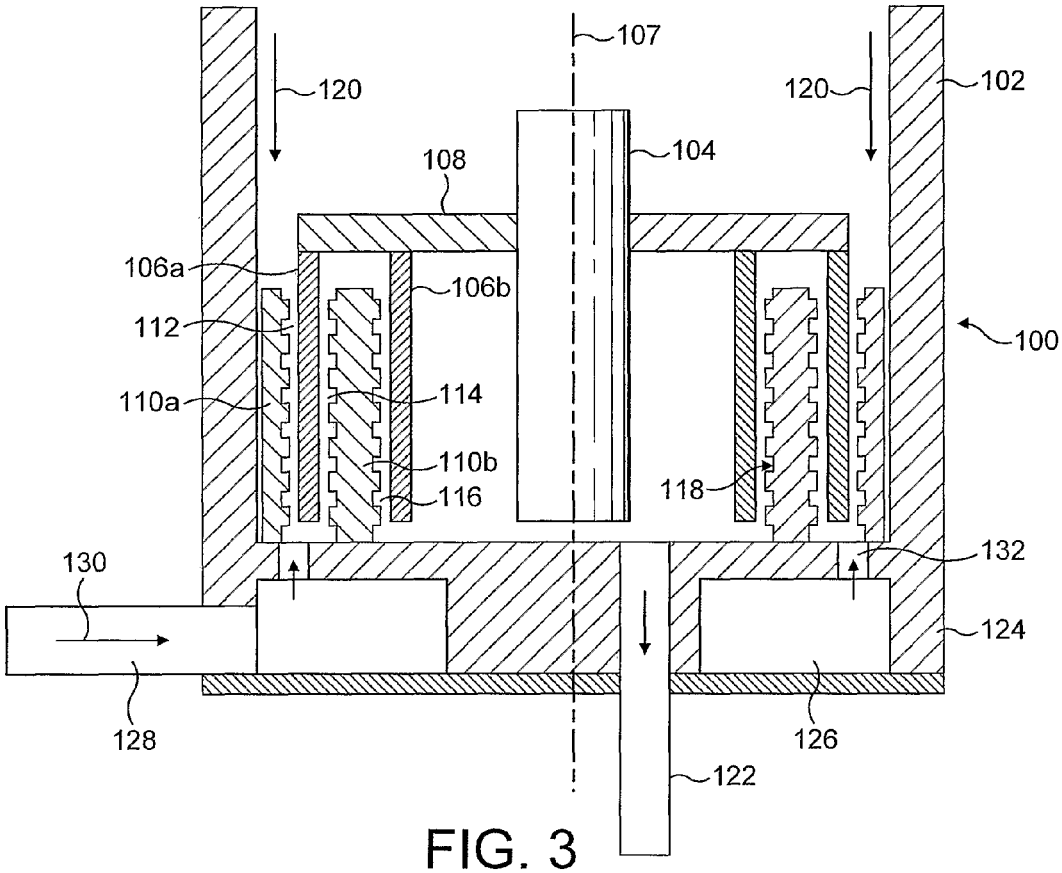
FIG. 3 is a cross-section through part of a first embodiment of a vacuum pump.

With reference to FIG. 3, a first embodiment of a vacuum pump 100 comprises a multi-component body 102 within which is mounted a drive shaft 104. Rotation of the shaft is effected by a motor (not shown), for example, a brushless dc motor, positioned about the shaft 104. The shaft 104 is mounted on opposite bearings (not shown). For example, the drive shaft 104 may be supported by a hybrid permanent magnet bearing and oil lubricated bearing system.

A molecular drag pumping mechanism is located in the body 102. In this embodiment, the pumping mechanism is in the form of a multi-stage Holweck drag mechanism comprising two co-axial cylindrical rotor elements 106*a*, 106*b* of different diameters and which extend about the longitudinal axis 107 of the pump 100. The rotor elements 106*a*, 106*b* are preferably formed from a carbon fibre material, and are mounted on a disc 108 located on the drive shaft 104. The disc 108 may be mounted on the drive shaft 104, or may be integral therewith. A stator for the Holweck mechanism comprises two cylindrical stator elements 110*a*, 110*b* co-axial with the rotor elements 106*a*, 106*b* to define, in this embodiment, three pumping stages comprising first, second and third annular pumping chambers 112, 114, 116 located between the rotor elements 106*a*, 106*b* and the stator elements 110*a*, 110*b* and linked to form a continuous passageway. The surfaces of the stator elements 110*a*, 110*b* that face a rotor element are formed with helical channels 118 in a manner known per se.

The pump 100 has a first inlet (not shown) through which gas (indicated by arrows 120 in FIG. 3) can enter the pump 100 and pass through all of the chambers 112, 114, 116 of the Holweck mechanism before being exhaust from the pump 100 through pump outlet 122 located in the base 124 of the body 102. Additional pumping stages, such as one or more turbomolecular pumping stages and/or a helical thread rotor pumping stage, may be located between the first inlet and the Holweck mechanism to further reduce the pressure at the first inlet as required. Similarly, additional pumping stages, such as one or more aerodynamic pumping stages and/or a Gaede drag pumping stage, may be located between the downstream Holweck stage 116 and pump outlet 122 to raise the pressure at the pump outlet. The rotor elements for these additional pumping stages may also be located on the drive shaft 104. Additional pump inlets may also be provided upstream and/or downstream from these additional pumping stages as required.

Figure 4:
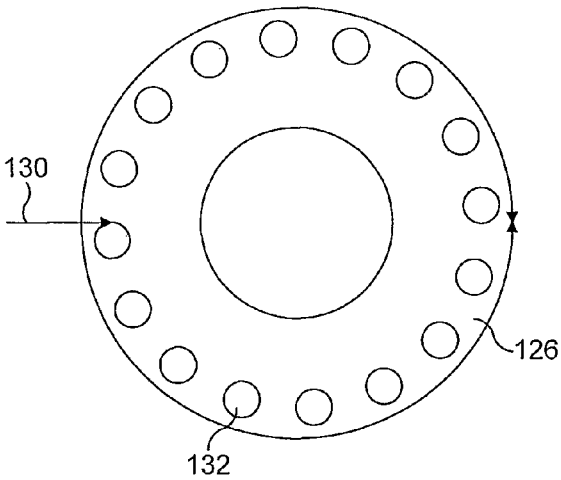
FIG. 4 is a top view of the plenum of the pump of FIG. 3.

The pump 100 also has a gas delivery system for delivering gas to a location between the stages of the Holweck mechanism. This gas delivery system comprises a plenum 126 located in the base 124 of the pump body 102. In this embodiment, the plenum 126 comprises an annular chamber extending about the longitudinal axis 107 of the pump 100 so as to not impinge on pump outlet 122. The plenum 126 has a plenum inlet 128 arranged such that gas (indicated by arrow 130 in FIG. 3) enters the plenum 126 at a single point in a substantially radial direction, although this could equally be in an axial direction. With reference to FIG. 4, the plenum 126 also has a plurality of plenum outlets 132 arranged about the longitudinal axis 107 of the pump 100 to enable the gas delivery system to deliver gas to the annular channel 114 of the Holweck mechanism. In this embodiment, the plenum outlets 132 are circularly and evenly spaced about the longitudinal axis 107, although other equispaced geometries may be employed.

In use, the first inlet is connected to a chamber in which a relatively low pressure is to be created. Gas from this chamber enters the pump 100 through the first inlet, passes through any additional pumping stages located between the first inlet and the Holweck mechanism, and passes through all of the channels 112, 114 and 116 of the Holweck mechanism before leaving the pump 100 through the pump outlet 122. The plenum inlet 128 is connected to another chamber in which a relatively high pressure is to be created. Gas from this chamber enters the plenum 126 through the plenum inlet 128. As the plenum 126 of the pump 100 is located remote from the Holweck mechanism, the plenum 126 can therefore be larger and less restrictive than the plenum 34 of the prior pump 10; in contrast, the plenum 34 of the prior pump 10 shown in FIG. 1 is located within the Holweck mechanism. The conductance of the plenum 126 is thus much higher than that of the plenum 34, and as a consequence, the gas entering the plenum 126 through the plenum inlet 128 can be rapidly and evenly distributed about the plenum 126 before leaving the plenum 126 through the plenum outlets 132. From the plenum outlets 132, the gas 130 enters the annular chamber 114 of the Holweck mechanism, and passes through the channels 114 and 116 before leaving the pump 100 through the pump outlet 122. Due to the even distribution of gas within the plenum 126, each plenum outlet 132 only carries a small portion of the gas load and hence the diameter of the plenum outlets 132 can be relatively small without generating a pressure loss between the plenum inlet 128 and the annular channel 114.

Furthermore, as the internal plenum 34 of the Holweck mechanism of the prior art pump 10 is no longer required, the rotor element 106*a* and stator element 110*a* of the pump 100 can be extended in comparison to the rotor element 12*a* and stator element 18*a* of the pump 10, further improving the pump performance.

Figure 5:
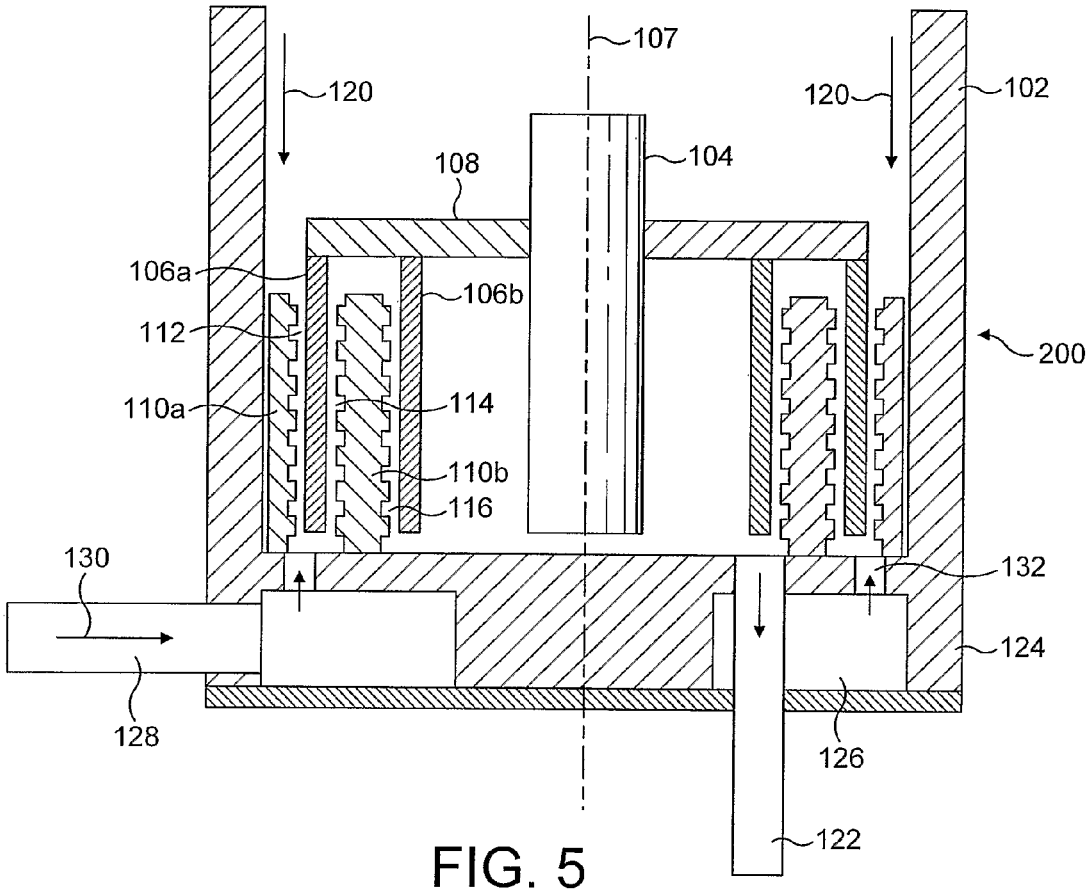
FIG. 5 is a cross-section through part of a second embodiment of a vacuum pump.
Figure 6:
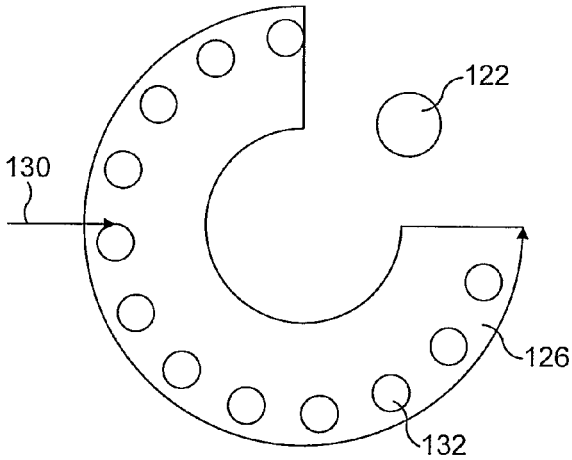
FIG. 6 is a top view of the plenum of the pump of FIG. 5.

In this first embodiment, the location of the pump outlet 122 is such that the plenum 126 could be readily machined in the form of an annular chamber. However, depending on the pump layout, certain pump features could restrict the shape of the plenum 126. For example, in the second embodiment shown in FIG. 5, in which features similar to those of the first embodiment shown in FIG. 3 have been given the same reference numerals, the pump outlet 122 is locate closer to the third annular chamber 116 than in the first embodiment, with the result that the plenum 126 cannot adopt the annular shape of the first embodiment without impinging on the pump outlet 122. Whilst the internal diameter of the plenum could be increased to enable the pump outlet 122 to pass inside the internal periphery of the plenum, this could severely compromise pump conductance. In view of this, the shape of the plenum 126 can be modified, as shown in FIG. 6, so that the plenum 126 does not extend fully about the longitudinal axis 107 of the pump 200. In the illustrated embodiment, the plenum 126 extends approximately 2700 about the longitudinal axis 107 of the pump 200, providing space to accommodate other pump features such as the pump outlet, electrical connectors, vent purges and the like, with the plenum outlets 132 being arranged in an arc extending about the longitudinal axis, so that the gas 130 leaving the plenum 126 can be evenly distributed about as much of the annular chamber 114 as possible given the constraints of the pump design.

Figure 7:
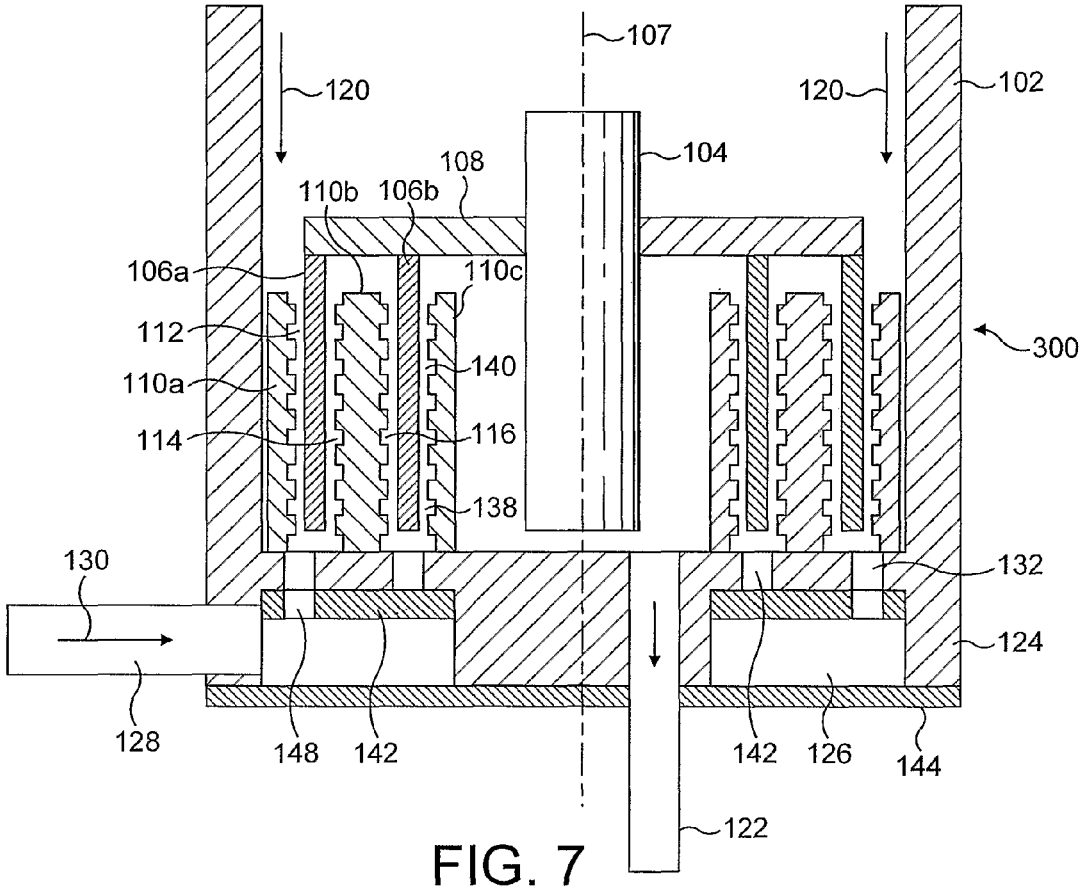
FIG. 7 is a cross-section through part of a third embodiment of a vacuum pump.

FIG. 7 illustrates a third embodiment of a vacuum pump 300; again features similar to those of the first embodiment shown in FIG. 3 have been given the same reference numerals. In this third embodiment, the Holweck mechanism has been extended to four stages by the inclusion of a third, inner cylindrical stator element 110*c* co-axial with the other two cylindrical stator elements 110*a*, 110*b*. The outer surface of the inner stator element 110*c* is formed with helical grooves 138, and defines with the inner rotor element 106*b* a fourth annular chamber 140 linked to the other three annular chambers 112, 114,116. As, during use, gas would flow through the fourth annular chamber 140 in the same direction as the gas flow through the second annular chamber 114 (with the gas flowing through the first and third annular chambers 112,116 in the opposite direction), in this embodiment the gas delivery system provides the user with the option of conveying gas from the plenum inlet 128 to either the second annular chamber 114 or the fourth annular chamber 140 depending on the pumping requirements of the chamber to be evacuated through the plenum inlet 128.

Figure 8:
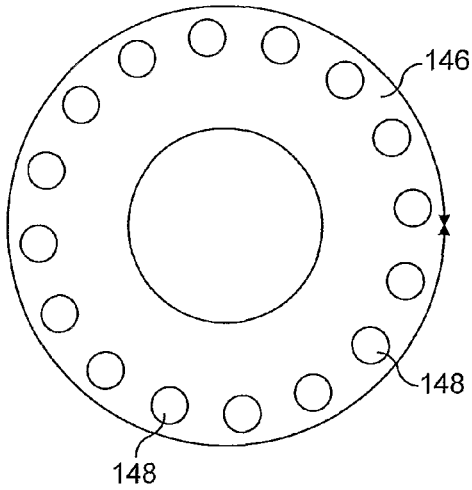
FIG. 8 is a top view of the plate of the pump of FIG. 7.

With reference to FIG. 7, in this embodiment the plenum 126 comprises, in addition to the first plurality of outlets 132, a second plurality of plenum outlets 142 arranged about the longitudinal axis 107 of the pump 300 to enable the gas delivery system to deliver gas directly to the fourth annular channel 140 of the Holweck mechanism, that is, not via any of the other three annular channels 112, 114, 116. In this embodiment, similar to the first plurality of plenum outlets 132, the second plurality of plenum outlets 142 is also circularly and evenly spaced about the longitudinal axis 107. In order to enable the user to specify the annular chamber to which the gas is to be supplied from the plenum 126, and thus the performance level of the plenum inlet 128, the end plate 144 of the base 102 of the pump 300 can be removed to enable the user to insert a plate 146, in this embodiment in the form of an annular disc 146, having, as shown in FIG. 8, a plurality of apertures 148 positioned such that, when the plate 146 is inserted in the plenum 126, the apertures 148 expose only the chosen plurality of plenum outlets. As shown in FIG. 7, the disc 146 may be removably located in the roof of the plenum 126 using any suitable means, such as bolts or the like. In this embodiment, the disc 146 has apertures 148 for exposing only the first plurality of plenum outlets 132, and so serves to isolate the second plurality of outlets 142, and thus the fourth annular chamber 140, from direct communication with the plenum 126. The disc 146 may be formed with a datum or otherwise profiled to assist the user in the alignment of the apertures 148 relative to the first plurality of outlets 132.

Figure 9:
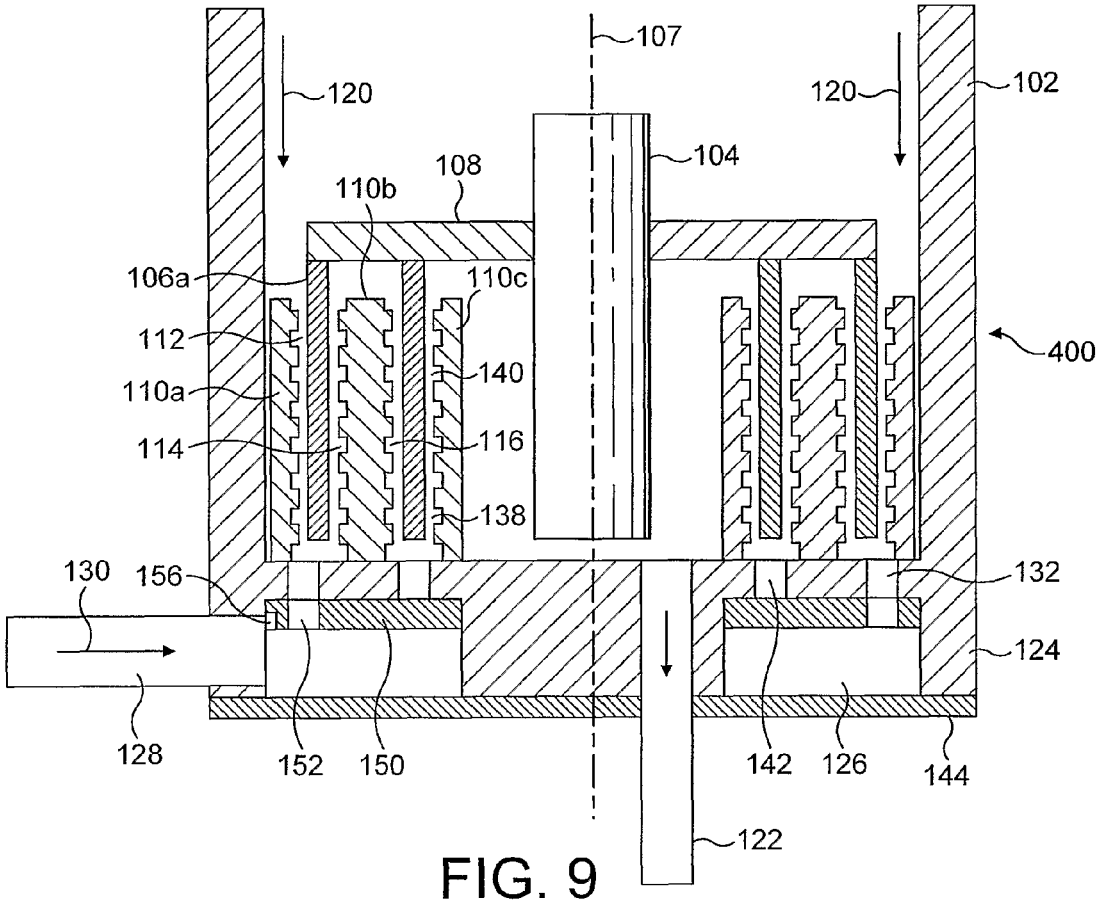
FIG. 9 is a cross-section through part of a fourth embodiment of a vacuum pump.
Figure 10:
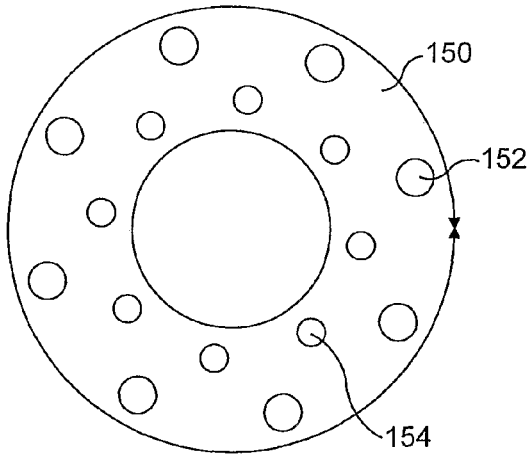
FIG. 10 is a top view of the plate of the pump of FIG. 9.

In this embodiment, in order to expose the second plurality of plenum outlets 142 instead of the first plurality of plenum outlets 132, the user would be required to replace the disc 146 with another disc having a different arrangement of apertures so that this disc would serve to both open the second plurality of plenum outlets 142 and close the first plurality of plenum outlets 132. Whilst providing a simple, low cost technique for providing different performance levels at a common plenum inlet 128, depending on the location of the pump 300 replacement of the disc may, in practice, prove difficult. The fourth embodiment of a vacuum pump 400, as shown in FIG. 9, seeks to solve this problem by providing a common disc 150 for both the first and second pluralities of plenum outlets 132, 142. As shown in FIG. 9, the disc 150 is located in the same position as the disc 146 of the third embodiment. With reference to FIG. 10, the disc 150 comprises a first set of apertures 152 for supplying gas from the plenum 126 to the first plurality of outlets 132, and a second set of apertures 154 for supplying gas from the plenum 126 to the second plurality of outlets 142. In this embodiment, the second set of apertures 154 is rotationally offset from the first set of apertures 152 by approximately one half of the pitch of the first set of apertures 152.

The disc 150 is rotatably mounted in the roof of the plenum 126 by any suitable means such that the disc 150 is rotatable about the longitudinal axis 107 between a first position shown in FIG. 9, in which the first set of apertures 152 are aligned with the first plurality of outlets 132 and the second plurality of outlets 142 are closed by the disc 150, and a second position in which the second set of apertures 154 are aligned with the second plurality of outlets 142 and the first plurality of outlets 132 are closed by the disc 150. The plenum inlet 128 can provide user access to the disc 150 for rotation between the first and second positions. As shown in FIG. 9, a notch 156 or other form of indicator can be located on the side of the disc 150 such that it is visible through the plenum inlet 128 to allow a user to determine visually the position of the disc 150 and thus the current performance configuration of the plenum inlet 128, for example, through alignment of the notch with markings provided on the body 102 of the pump 400.

Where the Holweck mechanism contains additional pumping stages, or where additional pumping stages are provided downstream from the Holweck mechanism, such as a Gaede or regenerative pumping stage, further sets of apertures can be provided as required to increase the range of performance levels of the plenum inlet 128.

In the preferred embodiments described above, the plenum 126 has been used to connect a vacuum chamber to the pump. However, the plenum 126 may alternatively be used to connect another pumping mechanism to the Holweck mechanism. This pumping mechanism may be external to the pump, for example, in the form of a turbomolecular pump connected between the vacuum chamber and the pump for evacuating the vacuum chamber and exhausting gas to the plenum inlet 128, or it may be another internal pumping mechanism of the pump, for example a regenerative or Gaede pumping mechanism, which requires a linear flow pattern at the inlet thereof.

Furthermore, in each of the first to fourth embodiments, the plenum 126 has been used to re-distribute gas from a linear flow pattern, entering the plenum radially or axially through the plenum inlet 128, to an annular flow pattern which leaves the pump through the plenum outlets 132. In the fifth embodiment shown in FIG. 11, which is based on the fourth embodiment shown in FIG. 9, the plenum 126 is instead used to re-distribute gas from an annular flow pattern to a linear flow pattern.

Figure 11:
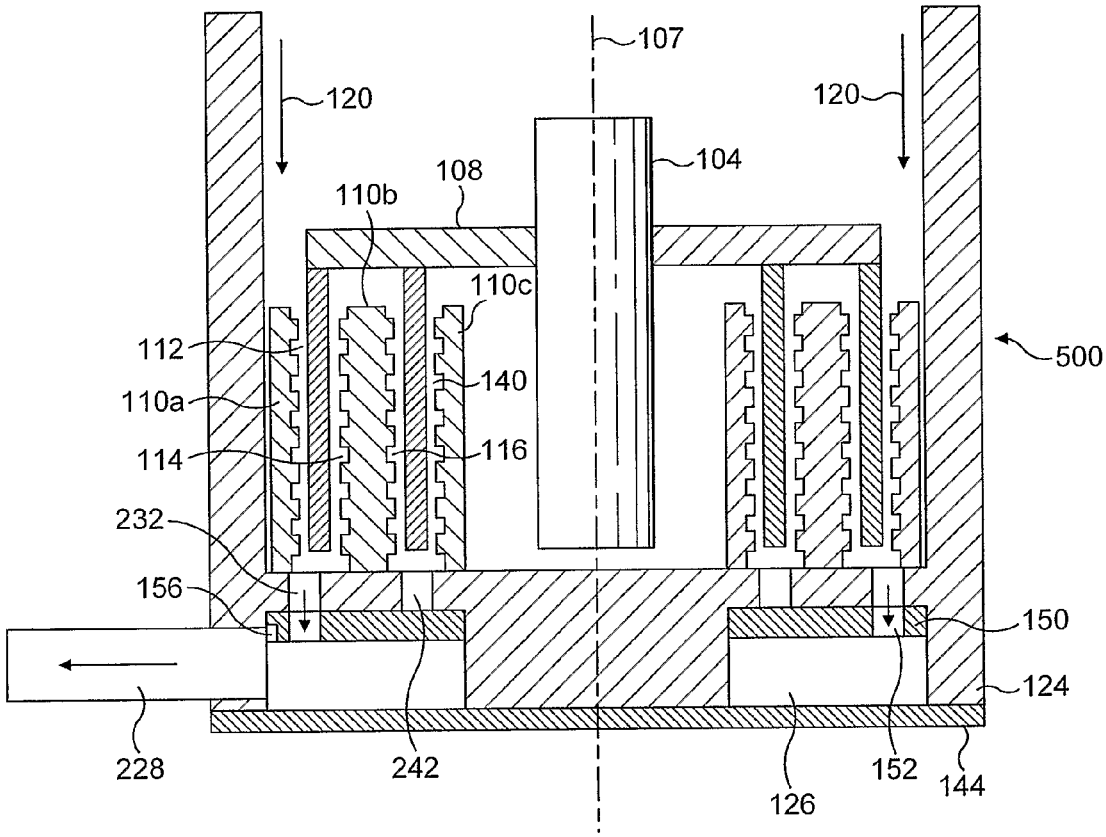
FIG. 11 is a cross-section through part of a fifth embodiment of a vacuum pump.

In comparison to the fourth embodiment, in this fifth embodiment the pump outlet 122 is removed, and the respective functions of the plenum inlet and plenum outlets are reversed (and so in FIG. 11, reference numerals 228, 232 and 242 are used to indicate the plenum outlet, the first plurality of plenum inlets and the second plurality of plenum inlets respectively of the pump 500). With the disc 150 in its first position as discussed with reference to FIG. 9, gas 120 entering the lo pumping mechanism from the first pump inlet passes through the first annular chamber 112, enters the plenum 126 through the first plurality of plenum inlets 232 and first set of apertures 152 in the disc 150, and leaves the plenum 126 through the plenum outlet 228. With the disc 150 in the second position, gas 120 entering the pumping mechanism from the first pump inlet passes through the first, second and third annular chambers 112, 114, 116, enters the plenum 126 through the second plurality of plenum inlets 242 and second set of apertures 154 in the disc 150 (as shown in FIG. 10), and leaves the plenum 126 through the plenum outlet 228. As a result, the performance of the first pump inlet can be adjusted as required.

Again, similar to the first to fourth embodiments described above, in the fifth embodiment the plenum 126 may be used to connect another pumping mechanism to the Holweck mechanism. This pumping mechanism may be external to the pump, for example, in the form of a backing pump connected to the plenum outlet 228 to pump gas exhaust from the pump 500 through the plenum outlet 228, or it may another internal pumping mechanism of the pump, for example a regenerative or Gaede pumping mechanism, which requires a linear flow pattern at the inlet thereof.

While the foregoing description and drawings represent the preferred embodiments of the present invention, it will be apparent to those skilled in the art that various changes and modifications may be made therein without departing from the true spirit and scope of the present invention.

I claim:

1. A vacuum pump comprising a pumping mechanism having an annular pumping chamber extending about a longitudinal axis and through which fluid is to be pumped by the pumping mechanism, and means for delivering fluid to the annular chamber, said means comprising a plenum located remote from the pumping mechanism and having an inlet for receiving fluid to be pumped by the pumping mechanism and a plurality of outlets arranged about the longitudinal axis for supplying fluid to the annular chamber in parallel with the longitudinal axis.

2. The pump according to claim 1 wherein the outlets are equidistantly spaced about the longitudinal axis.

3. The pump according to claim 1 wherein the outlets are equidistantly spaced from the longitudinal axis.

4. The pump according to claim 1 wherein the plenum comprises an annular chamber extending about the longitudinal axis, the outlets being arranged circularly about the longitudinal axis.

5. The pump according to claim 1 wherein the plenum comprises a chamber extending less than 360° about the longitudinal axis, the outlets being arranged in an arc extending about the longitudinal axis.

6. The pump according to claim 1 wherein the pumping mechanism comprises a first, outer annular chamber and a second, inner annular chamber co-axial with the first annular chamber, said means being arranged to supply fluid to a selected one of the annular chambers.

7. The pump according to claim 6 wherein said means comprises a first, outer plurality of outlets arranged about the longitudinal axis for supplying fluid to the first annular chamber, a second, inner plurality of outlets arranged about the longitudinal axis for supplying fluid to the second annular chamber, and closure means for selectively closing one of the first and second pluralities of outlets.

8. The pump according to claim 7 wherein the closure means comprises a planar member located between the plenum and the outlets for selectively closing said one of the first and second pluralities of outlets.

9. The pump according to claim 7 wherein the closure means comprises at least one aperture through which fluid is conveyed from the plenum to the other of the first and second plurality of outlets.

10. The pump according to claim 7 wherein the closure means comprises a plurality of apertures each of which is co-axial with a respective outlet of the other of the first and second pluralities of outlets.

11. The pump according to claim 7 wherein the closure means is movable between a first position in which the first plurality of outlets are closed, and a second position in which the second plurality of outlets are closed.

12. The pump according to claim 11 wherein the closure member comprises a first set of apertures and a second set of apertures positioned such that in the first position each of the apertures from the first set is co-axial with a respective outlet of the first plurality of outlets, and in the second position each of the apertures from the second set is co-axial with a respective outlet from the second plurality of apertures.

13. The pump according to claim 12 wherein the plate is rotatable about the longitudinal axis between the first and second positions to close the selected plurality of outlets.

14. The pump according to claim 12 wherein the closure means comprises means for indicating the position thereof.

15. The pump according to claim 6 wherein the first and second annular chambers are linked to form a continuous passageway through which fluid is pumped by the pumping mechanism.

16. The pump according to claim 15 wherein the pumping mechanism comprises a multi-chamber molecular drag pumping mechanism comprising a plurality of co-axial cylindrical rotor elements and a stator defining with the rotor elements the first and second annular chambers.

17. The pump according to claim 16 wherein the molecular drag pumping mechanism is a multi-stage Holweck mechanism in which the first and second annular chambers are arranged as a plurality of helixes.

18. A vacuum pump comprising a pumping mechanism having an annular pumping chamber extending about a longitudinal axis and through which fluid is to be pumped by the pumping mechanism, and means for receiving fluid from the annular chamber, said means comprising a plenum located remote from the pumping mechanism and having a plurality of inlets arranged about the longitudinal axis for receiving fluid from the annular chamber in parallel with the longitudinal axis and an outlet for exhausting fluid from the plenum.

19. The pump according to claim 11 wherein the first and second annular chambers are linked to form a continuous passageway through which fluid is pumped by the pumping mechanism.

* * * * *